US010463225B2

(12) United States Patent
Bruno et al.

(10) Patent No.: US 10,463,225 B2
(45) Date of Patent: Nov. 5, 2019

(54) AUTOMATIC DOSING METHOD

(71) Applicant: SEKO S.p.A., Cittaducale, Rieti (IT)

(72) Inventors: Maurizio Jafet Bruno, Rieti (IT); Luigino Esposito, Rieti (IT); Adrio Pantaleoni, Rieti (IT)

(73) Assignee: SEKO S.P.A., Rieti (IT)

( * ) Notice: Subject to any disclaimer, the term of this patent is extended or adjusted under 35 U.S.C. 154(b) by 8 days.

(21) Appl. No.: 15/743,959

(22) PCT Filed: Jul. 21, 2016

(86) PCT No.: PCT/IB2016/054350
§ 371 (c)(1),
(2) Date: Jan. 11, 2018

(87) PCT Pub. No.: WO2017/013615
PCT Pub. Date: Jan. 26, 2017

(65) Prior Publication Data

US 2018/0256004 A1 Sep. 13, 2018

(30) Foreign Application Priority Data

Jul. 21, 2015 (IT) ..... 1020155000036565

(51) Int. Cl.
*A47L 15/44* (2006.01)
*A47L 15/00* (2006.01)

(52) U.S. Cl.
CPC ..... *A47L 15/449* (2013.01); *A47L 15/0055* (2013.01); *A47L 2401/06* (2013.01); *A47L 2401/07* (2013.01); *A47L 2401/20* (2013.01); *A47L 2501/07* (2013.01)

(58) Field of Classification Search
None
See application file for complete search history.

(56) References Cited

U.S. PATENT DOCUMENTS 5,282,901 A 2/1994 Reinhard

FOREIGN PATENT DOCUMENTS

DE 10 2006 019 546 12/2007
EP 0 218 908 4/1987

OTHER PUBLICATIONS

International Search Report dated Nov. 11, 2016 issued in PCT International Patent Application No. PCT/IB2016/054350, 2 pp.

*Primary Examiner* — Nicole Blan
(74) *Attorney, Agent, or Firm* — Nixon & Vanderhye P.C.

(57) ABSTRACT

An automated dosing method for dosing a chemical in a tunnel dishwasher includes the steps of: detecting a rinse signal from a supplying solenoid valve for supplying a rinse water of the dishwasher; dosing a detergent amount apt to be inserted in a washing liquid, at a first load configuration of the dishwasher, for obtaining a washing mixture; and dosing a further detergent amount, apt to be inserted in the washing liquid for a restoration of the detergent in the washing mixture at an operating configuration of the dishwasher. The dosing step of a further detergent amount is performed periodically according to a predetermined time frequency.

10 Claims, 1 Drawing Sheet

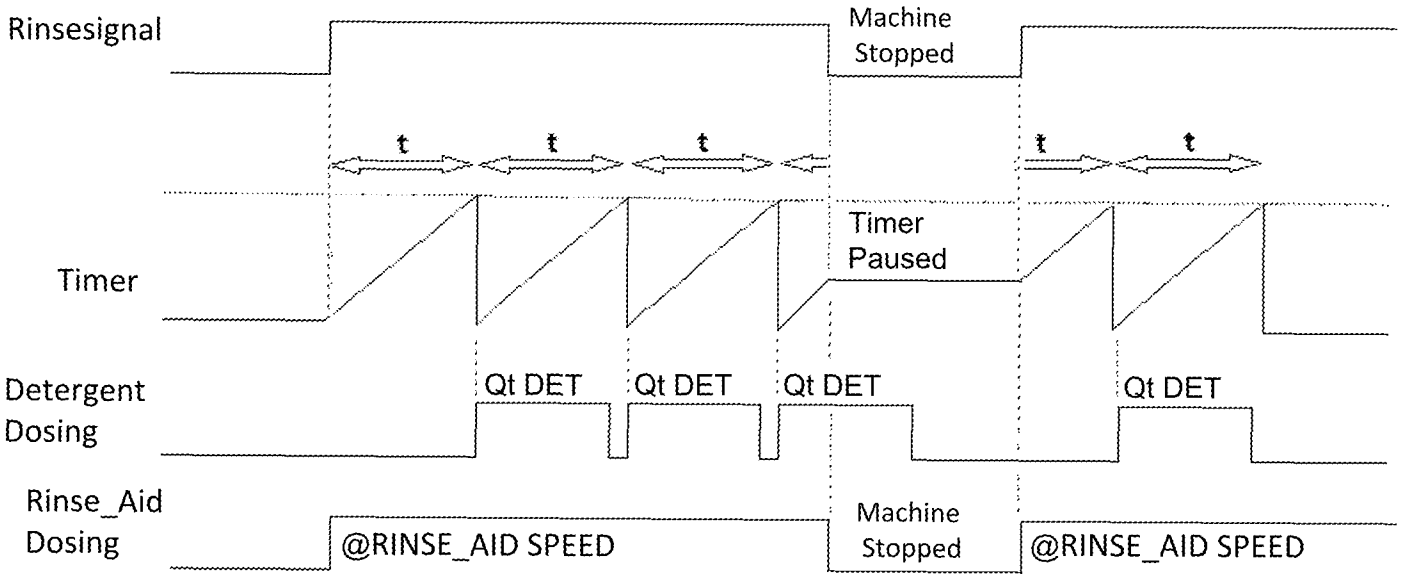
Rinsesignal
Timer
Detergent Dosing
Rinse_Aid Dosing
Machine Stopped
t
t
t
t
t
Timer Paused
Qt DET
Qt DET
Qt DET
Qt DET
Machine Stopped
@RINSE_AID SPEED
@RINSE_AID SPEED

AUTOMATIC DOSING METHOD

This application is the U.S. national phase of International Application No. PCT/IB2016/054350 filed Jul. 21, 2016 which designated the U.S. and claims priority to Italian Patent Application No. 102015000036565 filed Jul. 21, 2015, the entire contents of each of which are hereby incorporated by reference.

The present invention relates to a dosing method, in particular an automatic dosing method, which is adapted to automatically calibrate the amount of the chemical to be inserted in a washing tank, which allows in a simple, reliable, efficient and economical way to reduce drastically the chemical product waste during the operation of a washing machine, in particular a dishwasher.

In the tableware cleaning and disinfection field, dishwasher machines allow both the treatment exclusively with water, and the addiction of concentrated chemicals, such as detergents, rinse aid and sometimes additives.

Such machines include apparatus for the mixing of the various substances with water, such as metering pumps, which are activated for dosing (i.e. time delivery) a given quantity of chemical product. Each product must be dosed and inserted into the washing cycle at certain phases of the cycle and in the appropriate quantity.

As regards the detergent dosing operation, this is usually carried out in two distinct phases of the washing steps.

A first detergent dosing is carried out at the so-called "first load", i.e. at the first water loading in the washing tank. A further detergent dosing, so-called "recovery", is made at the end of each washing subsequent to the first, or periodically, depending on the specific operation conditions of the dishwasher.

In particular, the recovery steps are carried out at the end of each washing subsequent to the first in the so-called "single tank" dishwasher, while are carried out periodically—or at a predetermined time interval—in the "tunnel" machines.

The dosing operations and the detergent insertion relative to the first load can be activated either by reading an electric signal from the dishwasher machine (automatic dosing), and by the pressure of a specific key by the operator on the dosing device (manual dosing).

In order to determine the chemical product amount which must be dosed at the "first load" condition, specific parameters are set on the dosing device, for example, the tank capacity and the detergent concentration to be obtained, in such a way that, by the knowledge of the flow rate of the detergent dosing pump, at each first load the dosing device activate the pump for the time necessary to reach the chemical concentration in the water suggested by the manufacturer of the detergent, according to the preset parameters.

At the end of each washing cycle, or periodically, as already said a recovery operation by the delivering of a further amount of detergent, have to be carried out to compensate the detergent used for the preceding washing and to consider the not soapy water added in the tank during the rinsing operation.

The recovery operation is an automatic operation, which is based on specific machine parameters defined and set by the operator.

In single tank machines, wherein washing and rinsing are temporally subsequent each other in the same environment, the recovery is performed at the end of each washing cycle, immediately after rinsing, so as to restore in the tank the correct concentration for the subsequent washing.

In the tunnel machines, in which washing and rinsing take place simultaneously in two distinct environments, however sharing the lower tank, the recovery is carried out periodically, taking into account the average time of a washing cycle.

In both cases, the dosing system must be able to determine the product amount that have to be dosed to determine the optimal conditions for the subsequent washing.

In the known prior art the operation of the dosing pumps is bound to specific values read by means of probes inserted in the washing liquid, such as conductivity probes. Therefore, by the chemical/physical characteristics measurement of the water in the washing tank, the metering device determines the amount of detergent to be dispensed.

However, the dosing methods of the prior art suffer from certain drawbacks.

First of all, the prior art methods are expensive, as the sensors for measuring the conductivity and the electronics required for their management have a not negligible cost with respect to the entire dosing system and also the installation operation of the sensor has a cost not negligible, considering that it should only be done by qualified operators. In fact, for installing a conductivity probe it is necessary to make a hole in the tank of the dishwasher machine and then ensure that the probe and its seals ensure the necessary sealing and do not generate losses of water from the tank.

In addition, the sensors adapted to detect the chemical/physical characteristics of the water in the washing tank, for example a probe for the detection of the conductivity or concentration of detergent inside the washing tank, are subject to degradation and/or accumulation of residues that can distort the measurement of the actual revealed value. The possibility of degradation and/or accumulation of residues on the probe obviously increases as the number of performed washing cycles. Therefore, these sensors have to be cleaned regularly, and this is an additional managing cost.

Moreover, the measures revealed by the sensors are dependent also on the dissolution quality of the detergent inserted in the water which is not always optimal and which depends on numerous factors, such as the specific water feature (more or less calcareous) or the higher or lower amount of fat located on the dishes of a particular washing cycle.

A drawback of the known types dosing methods is that, in addition to the influence of the dosed detergent quantity, the conductivity value detected by the dosing system at each washing cycle could be influenced by factors such as the specific water quality, the specific cleaning degree of the probe, the specific reading calibration degree of the probe, factors that can also greatly vary between a washing cycle and the other.

Therefore, in the prior art, the washing cycles subsequent to the first washing cycle, can be carried out in a not optimal mixing conditions between detergent and water, thus affecting the efficiency of the system and the washing quality.

In fact, in the case of soiling of the probe for example, the conductivity measurement or the concentration measurement of the detergent internal to the washing water is distorted and the delivery pump is commanded to deliver a detergent amount considerably higher than the necessary. A detergent excess can cause foam excesses with possible leakage of water from the machine, resulting in waste of material and highly polluting situations.

An incorrect detergent dosage may also produce an increasing of the solid residues not only on the dishes but also inside the machine, resulting in an acceleration of the damage phenomena of the machine. In fact, because of too high detergent doses, some solid detergent clusters could be created, which are deposited inside the dishwasher and which could clog the components of the water circuit by means of clusters that harden over time causing various kinds of malfunctioning.

Therefore, the detergent dosing phase is an extremely delicate phase of the entire washing process, both as regards the washing performance, but also as regards the safety of the machine.

Similarly, also the rinse aid must be dosed in a suitable manner, so that to ensure a good result of the washing operations. The rinse aid is a chemical product which, dosed in a suitable amount, is mixed to the clean water used for the rinsing operations of the dishes and helps to prevent the calcareous formations on the dishes, decreasing the water surface tension and encouraging the sliding of the rinsing water on the washing crockery surfaces.

Therefore, the technical problem posed and solved by the present invention is to provide a detergent dosing method which allows to obviate the drawbacks mentioned above with reference to the prior art.

This problem is solved by a dosing method according to claim 1. Preferred features of the present invention are shown in the dependent claims.

Advantageously, the object of the present invention allows to preserve the integrity of the dishwasher by means of an automatic calibration of the detergent dosing.

A further advantage is the possibility of increasing the washing cycle efficiency. A still further advantage is the possibility to preserve the integrity of the dishwasher ensuring the dosing accuracy and greatly reducing the need for manual intervention thereby reducing the processing costs.

Other advantages, features and the modes of employ of the present invention become evident from the following detailed description of some embodiments, descried by way of not limiting example.

The present invention is now described, for illustrative but not limitative purposes, according to its preferred embodiments, with particular reference to FIG. 1 of the attached drawing, which schematically shows the time course of some characteristic parameters of the object of the present invention.

The described method is particularly aimed to the dosing of detergent and/or rinse aid, in an industrial dishwasher of the tunnel kind.

As mentioned above, differently from the single tank washing machines, the tunnel machines have two separate environments, one for washing and the other for rinsing, environments sharing a same tank below.

In these machines, the racks, containing the crockery to be washed, pass through the entire dishwasher entering from one end of the machine and exiting from the opposite side, and the washing and rinsing phases take place simultaneously in different environments: while in one of the rooms the washing of a rack of dirty crockery is in progress, in another room the rinsing of another rack of crockery, already washed at an earlier time, takes place.

The method according to one embodiment of the present invention comprises a first step of a rinsing signal acquisition (RINSE signal), shown schematically in FIG. 1, corresponding to the actuation signal of the rinsing solenoid valve present in the dishwasher, i.e. of the solenoid valve which, when actuated, allows the passage of the rinsing water that is sprayed on the crockery to be rinsed.

The method is applicable regardless the specific kind of dishwasher, single or double solenoid valve.

In fact, in the so-called "double solenoid valve" dishwasher, a first solenoid valve dedicated to the loading of the water in the washing tank and a second solenoid valve dedicated to the rinsing operations are provided.

In the "single solenoid valve" dishwasher instead, the same valve is used for both the first loading and for rinsing. In this case the system detects the first loading condition based on the duration of activation of the sole available solenoid valve: a short-term activation (duration of less than a specific time threshold) is indicative of a rinsing phase, while an activation of long duration (higher than the specific threshold time duration) is indicative of a first loading phase. Typically, this time threshold is preset by the dosing system.

In both cases, the method according to the present invention provides an activation or a pause of a counter of the recovery phase as a function of the RINSE signal, in particular of the actuation signal of the rinsing solenoid valve.

As already mentioned, a first detergent dosing phase is carried out when a first loading condition is established, or when the empty washing tank of the dishwasher is filled with clean water, which in an industrial tunnel dishwasher generally occurs every two or three days or, in some cases, once a day.

The dosing phase of the first detergent loading comprises a step of inserting a determined detergent amount into the water previously inserted in the tank, defined in grams/liter by the manufacturer of the chemical product. In particular, it is necessary to not exceed this recommended amount of detergent to allow the dissolution of the detergent in the water and to not compromise the operation efficiency of the dishwasher.

The capacity of the washing tank is a defined parameter, which is preset by the operator.

Advantageously, using the above mentioned parameters, the method according to the invention obtains in an automatic way the detergent quantity required for the dosing operation as the product of the volumetric capacity of the tank (defined in liters) and the value of the detergent concentration (defined in grams/liter by the chemical product manufacturer).

Once the dosage relative to the first load have been done, the washing mixture in the tank, for example comprising the first loading water and the detergent dosed, it is in the ideal condition to perform the washing of the crockery.

During the washing step, the washing pump of the tunnel dishwasher machine takes the washing mixture from the washing tank, which is located in the lower part of the machine, and splash the pressurized mixture on the crockery in order to obtain the washing. In the tunnel dishwasher, although there are two distinct environments for washing and for rinsing the crockery, these sharing the underlying tank and therefore in the washing tank the clean and not soapy water used for rinsing is collected.

Obviously, the cleaning power of the mixture contained in the washing tank decreases during the operation of the machine because the rinsing water, not soapy, continuously falls into the washing tank and constantly dilutes its contents. As the washings are followed, it is therefore necessary to perform a detergent recovery phase, i.e. a dosing phase of a further amount of detergent to bring the washing mixture in the ideal detergent concentration conditions. Advantageously, the step of dosage of the additional amount of detergent of the further quantity of detergent (i.e. the recovery phase) is performed periodically according to a predetermined time frequency but adjusted by the RINSE signal, namely the activation of the rinsing solenoid valve.

As shown in the graph in FIG. 1, at the acquisition of the rinsing signal, a counter, which divides into a plurality of time intervals, of defined time duration "t", the time duration of the rinsing signal, is activated, that as said in a tunnel dishwasher is a substantially continuous signal, during all the time in which the dishwashing machine is in operation.

Advantageously, the division of the rinsing duration in defined time intervals "t" allows to determine in an automatic the moment when it is necessary to dose the further detergent amount required for recovery the washing conditions, and also the relative amount to be dosed.

This amount is in fact obtainable from parameters defined and preset in the dosing system, in particular as the product of the volumetric flow rate of water used for rinsing (defined in liters/second), the recovery period "t" (defined in seconds) and the value of the detergent concentration to be obtained in the tank (defined in grams/liter by the manufacturer of the chemical product).

As schematically shown in FIG. 1, at each time interval "t" the method according to the present invention provides the dosing of a quantity of detergent in the washing water, calculated as described before:

*Qt. DET*=Flow Rate Rinsing Watert*DET* desired concentration.

In a first embodiment of the method according to the present invention, the time "t" is set in such a way as to be equal to the average time of a washing, that is to say to the transit time of a rack of crockery.

Advantageously, such kind of approach provides a detergent recovery in the tank at each leakage of a clean rack from the machine.

In an alternative embodiment, it is possible to perform a more or less frequent detergent restoration, without varying the amounts dispensed. For example, if 1 liter of clean water per minute is utilized for rinsing and a detergent concentration in the tank equal to 10 grams/liter have to be maintained, to compensate the clean water that continuously falls in the tank, 10 grams per minute or 5 grams every half minute or 30 grams every 3 minutes have to be dispensed without varying the dosing concentration nor the detergent consumption. In particular, more frequent is the dosing, more time the concentration degree of detergent in the washing tank is maintained constant. The user can thus advantageously program the parameter "t" in order to obtain the dosing frequency more suitable for his specific application.

At the end of the "t" period, the dosing system based on the method according to the present invention, therefore, it will activate automatically the detergent dosing pump, preferably with a value of maximum speed of the pump, for the time required for dosing a detergent amount obtained from the product defined above.

As regards the rinse aid dosing, at the first loading conditions, the dosing is not performed. The rinsing water containment boiler remains in fact loaded with water and rinse aid dosed in the last rinse phase before switching off the machine, for example the last rinse phase of the day before. In case of absolute first actuation of the machine, when the containment boiler is empty, the rinse aid dosing is still performed at the first rinsing stage.

In particular, at a rinsing signal, the rinse aid dosing is carried out taking into account the flow rate of the water used in the rinsing phase. The rinse aid is inserted in the duct that carries cold water to the containment boiler. Here the water is heated to a specific temperature T to ensure that the added rinse aid is correctly activated and the mixture of water and rinse aid can therefore be used for the crockery rinsing. The rinse aid inside the boiler has to be recovered during the rinsing cycle to ensure that the water and rinse aid mixture inside the boiler is always in suitable proportions to ensure optimal efficiency of the rinsing operations.

RINSE Flow Rate=Rinsing Water Flow Rate*Desired RINSE Concentration

Advantageously, the method according to the invention also provide in an automatic way the activation mode of the rinse aid pump, required to obtain a correct dosing of this chemical.

In fact, by a knowledge of the volumetric flow rate of the water used for rinsing (defined in liters/second), and thus also the flow rate of clean water that at every second enters in the boiler until the RINSE signal is active, and defined the rinse aid concentration which has to be maintained in the boiler (defined in grams/liter by the manufacturer of the chemical product), the dosing system based on the method according to the present invention adjust automatically the speed of the rinse aid dosing pump, in such a way as to ensure the flow rate of the chemical product required to maintain constant the concentration of the rinse aid in the boiler. For example, at every second the system injects in the boiler the rinse aid quantity required for adding the correct amount of chemical to the clean water entering in the boiler at the same time.

As shown in the graphs of FIG. 1, as regards the detergent dosing, the method according to the present invention provides that, during a regular operation of the dishwasher (RINSE signal active) the dosing device, or the detergent dosing pump, is activated periodically at the end of the time interval "t" to inject in the tank the amount of chemical product calculated as described above. If the dishwasher were to be stopped for any reason (RINSE signal inactive) the internal counter is paused, and then continued his counting from the point at which it had arrived, as soon as the dishwasher starts (RINSE active signal).

Therefore, advantageously, the method according to the present invention comprises a suspending step for suspending a counter of the recovery time interval "t" at an interruption of the detection phase of the rinse signal, and a reactivation phase of the counter starting from a time "$t_s$" characteristic of the suspension phase, at a new detection of said rinsing signal.

Again, when the internal counter reaches a new time interval "t" of the set recovery time, a new dosing calculated as described above has to be done.

As regards the rinse aid instead, the dosing device, or the rinse aid dosing pump, is directly controlled by the rinse signal and until the latter is active, constantly doses chemical product into the water at the inlet of the boiler, as described above, or with a flow rate automatically calculated in such a way as to ensure the right concentration of chemical product in the clean water, which is fed into the boiler in a continuous manner.

If the machine is stopped for any reason (RINSE signal inactive) also the rinse aid dosing pump stops, and then starts again as soon as the dishwasher is reactivated again (RINSE signal active).

In this way, advantageously, even in case of malfunction, the delivery of the optimal and strictly necessary amount of product, so neither higher nor lower than the amount required for an efficient operation of the dosing system, is always guaranteed.

The present invention also includes an implementation of the described method via a computer program.

Advantageously, the computer program may be stored on a memory medium, for example readable by a programmable electronic device.

Furthermore, the computer program can be implemented through the development of software that can be supported by any programmable electronic device.

In the above preferred embodiments have been described and variants of the present invention have been suggested, but it is to be understood that the skilled in the art can make modifications and changes, without so departing from the related scope of protection, as defined by the attached claims.

The invention claimed is:

1. An automated dosing method for dosing a chemical product in a tunnel dishwasher, comprising the steps of:

detecting a rinse signal from a supplying solenoid valve for supplying a rinse water of the tunnel dishwasher;

dosing a detergent amount apt to be inserted in a washing liquid, at a first load configuration of the tunnel dishwasher, for obtaining a washing mixture;

activating a counter which divides the rinse signal into a plurality of recovery time intervals of defined time duration "t";

dosing an additional amount of detergent into the washing liquid periodically, at the end of the plurality of recovery time intervals "t", for restoring detergent in the washing mixture in order to maintain a detergent concentration during operation of the tunnel dishwasher, said method also comprising a suspending step for suspending the counter of a recovery time interval "t" at a time "$t_s$", if an interruption of the detection signal of the rinse signal occurs, and a reactivating step for reactivating the counter of the recovery time interval "t" from the time "$t_s$" as soon as a new detection of the rinse signal occurs.

2. The dosing method according to claim 1, further comprising a dosing step for dosing a rinse aid amount performed periodically.

3. The dosing method according to claim 2, wherein said dosing step for dosing the rinse aid amount has a flow rate, which is a function of a volumetric flow rate of water used in a rinsing phase.

4. The dosing method according to claim 2, wherein the dosing step for dosing the rinse aid amount is performed periodically according to said predetermined time frequency.

5. The dosing method according to claim 1, wherein said recovery time interval "t" is fixed or programmable by an operator.

6. The dosing method according to claim 1, wherein said dosing step of the detergent amount, at first load configuration, has a time duration, which is a function of a desired concentration value of the detergent in the washing mixture.

7. The dosing method according to claim 1, wherein said dosing step of the additional detergent amount has a time duration, which is a function of a volumetric flow rate of the water used in a rinsing phase.

8. The dosing method according to claim 7, wherein said time duration of the dosing step of the additional detergent amount is a function of said recovery time interval "t".

9. A dosing system for dosing a chemical product comprising:

a metering device; and a processing unit configured to perform an automated dosing method for dosing a chemical product in a tunnel dishwasher, comprising the steps of:

detecting a rinse signal from a supplying solenoid valve for supplying a rinse water of the tunnel dishwasher;

dosing a detergent amount apt to be inserted in a washing liquid, at a first load configuration of the tunnel dishwasher, for obtaining a washing mixture;

activating a counter which divides the rinse signal into a plurality of recovery time intervals of defined time duration "t";

dosing an additional amount of detergent into the washing liquid periodically, at the end of the plurality of recovery time intervals "t", for restoring detergent in the washing mixture in order to maintain a detergent concentration during operation of the tunnel dishwasher, said method also comprising a suspending step for suspending the counter of a recovery time interval "t" at a time "$t_s$", if an interruption of the detection signal of the rinse signal occurs, and a reactivating step for reactivating the counter of the recovery time interval "t" from the time "$t_s$" as soon as a new detection of the rinse signal occurs.

10. A non-transitory computer readable medium having stored thereon computer executable instructions that, when executed by a processing unit, perform an automated dosing method for dosing a chemical product in a tunnel dishwasher, comprising the steps of:

detecting a rinse signal from a supplying solenoid valve for supplying a rinse water of the tunnel dishwasher;

dosing a detergent amount apt to be inserted in a washing liquid, at a first load configuration of the tunnel dishwasher, for obtaining a washing mixture;

activating a counter which divides the rinse signal into a plurality of recovery time intervals of defined time duration "t";

dosing an additional amount of detergent into the washing liquid periodically, at the end of the plurality of recovery time intervals "t", for restoring detergent in the washing mixture in order to maintain a detergent concentration during operation of the tunnel dishwasher, said method also comprising a suspending step for suspending the counter of a recovery time interval "t" at a time "$t_s$", if an interruption of the detection signal of the rinse signal occurs, and a reactivating step for reactivating the counter of the recovery time interval "t" from the time "$t_s$" as soon as a new detection of the rinse signal occurs.

* * * * *